United States Patent [19]

Kolm

[11] 4,144,163

[45] Mar. 13, 1979

[54] MAGNETODENSITY SEPARATION METHOD AND APPARATUS

[75] Inventor: Henry H. Kolm, Wayland, Mass.

[73] Assignee: Sala Magnetics, Inc., Cambridge, Mass.

[21] Appl. No.: 584,186

[22] Filed: Jun. 5, 1975

[51] Int. Cl.[2] ..... B03B 7/00; B03C 1/30

[52] U.S. Cl. ..... 209/12; 209/127 R; 209/214; 209/223 R

[58] Field of Search ..... 209/223 R, 222, 232, 209/214, 221, 131.1, 39, 40, 478; 210/222, 223, 215, 121, 127 R

[56] References Cited

U.S. PATENT DOCUMENTS

| | | | |
|---|---|---|---|
| 468,706 | 2/1892 | Southworth | 209/232 |
| 653,344 | 7/1900 | Gates | 209/131.1 |
| 663,760 | 12/1900 | Johnson | 209/221 X |
| 736,298 | 8/1903 | Reed | 209/232 X |
| 1,056,318 | 3/1913 | Bruck | 209/232 |
| 1,527,069 | 2/1925 | Peck | 209/232 X |
| 1,948,419 | 2/1934 | Granigg | 209/232 X |
| 2,287,804 | 6/1942 | Johnson | 209/221 X |
| 2,913,113 | 11/1959 | Gillette | 209/221 X |
| 2,976,995 | 3/1961 | Forrer | 209/232 X |
| 3,136,720 | 6/1964 | Byermann | 210/222 |
| 3,463,319 | 8/1969 | Muragne | 209/223 R X |
| 3,567,026 | 3/1971 | Kolm | 210/222 |
| 3,822,016 | 7/1974 | Jones | 209/232 X |
| 3,849,301 | 11/1974 | Reading | 209/232 X |
| 3,856,666 | 12/1974 | Yashima | 209/232 X |
| 3,859,217 | 1/1975 | Holstead | 210/523 |
| 3,877,578 | 4/1975 | Morey | 209/215 |
| 3,966,590 | 6/1976 | Boon | 209/232 X |

FOREIGN PATENT DOCUMENTS

| | | | |
|---|---|---|---|
| 46-1678 | 7/1971 | Japan | 209/131 |
| 294559 | 11/1928 | United Kingdom | 209/106 |
| 401301 | 11/1933 | United Kingdom | 209/219 |
| 234266 | 5/1969 | U.S.S.R. | 209/39 |
| 385622 | 9/1973 | U.S.S.R. | 209/40 |

*Primary Examiner*—Robert Halper

*Attorney, Agent, or Firm*—Joseph S. Iandiorio

[57] ABSTRACT

Separating more magnetically susceptible particles from less magnetically susceptible particles carried in a fluid medium including simultaneously subjecting the medium to a magnetic field and a mechanical force field for separating the medium into a first flow in which magnetically susceptible particles magnetically flocculate under the influence of the magnetic field to form larger particles and a second flow which is adjacent and in communication with the first flow, and which moves locally transversely of the first flow; urging the larger particles from the first flow toward the second flow by means of the magnetic field and the mechanical force field and entrapping the larger particles entering the second flow by means of localized regions of high magnetic field gradient located along the path of the second flow.

44 Claims, 13 Drawing Figures

MAGNETODENSITY SEPARATION METHOD AND APPARATUS

FIELD OF INVENTION

This invention relates to a technique for separating particles on the basis of density and magnetizability of the particles and more particularly to such a separation technique simultaneously employing a magnetic field and a mechanical force field to effect the separation.

BACKGROUND OF INVENTION

It is often necessary to remove small, weakly magnetic grains of impurity from fibrous material, such as in the preparation of asbestos for use in high temperature electrical insulation and in the preparation of special tissue paper for use as a dielectric insulator in electric capacitors. The removal of impurity grains must be virtually complete because, for example, even a single grain in the hundreds of square meters of capacitor tissue used in a capacitor may make the product unacceptable. The removal of grains from fibrous media is extremely difficult. The fibers tend to envelop and trap the grains and the fibers are very prone to clogging. Fibrous fluids are usually pumped through highly polished ducts and fittings for any sharp protrusion would disrupt the streamlined flow causing "strapling" of the fibers: bending of the fibers over the obstruction. These characteristics of fibers and fiber separation marshall against the use of conventional high gradient magnetic separators, presently the most effective means for removing small, weakly magnetic particles, for such separators rely on a matrix of finely divided ferro-magnetic filamentary materials such as steel wool, mesh, or expanded metal which easily become clogged by the fibers. The more conventional, less effective magnetic separators do not appear to be adequate for this task. Typically present techniques for liberating granular impurities require that fibrous pulp must be handled in extremely dilute form typically 1% to 2.5% by weight in the case of asbestos and even more dilute in the case of capacitor tissue. In the opinion of some there is no wholly satisfactory method of separation for use in the preparation of capacitor tissue. In the preparation of insulating asbestos, where purity requirements may be much lower, there is a rather complex process being used, see U.S. Pat. No. 3,372,803. In this process the fiber pulp in the form of a 1% to 2.5% slurry is first passed at high velocity through several stages of cyclone in order to remove the largest of the impurity grains by centrifugal force. Next the slurry is passed through a solenoid magnet where it is subjected to a strong magnetic field which serves to magnetize particles that are capable of retaining magnetization (often referred to as magnetically "hard") so that they substantially coagulate into larger particles. Magnetically "soft" particles do not remain magnetized and therefore cannot be flocculated by a single pass through a magnet at high flow velocity. This process is mostly effective for magnetite grains and not so effective for material such as iron, hematite, and various other oxides. Subsequently the slurry is pumped through a smooth pipe into which protrude a plurality of poles of electromagnets which are designed to prevent "strapling" of the fibers while at the same time producing regions of low flow velocity such as eddies where granular particles of adequate size can be trapped.

SUMMARY OF INVENTION

It is therefore an object of this invention to provide an improved, simplified yet extremely effective magnetodensity separation method and apparatus.

It is a further object of this invention to provide such a separation method and apparatus which is extremely effective for separating weakly magnetic grains of impurities from fibrous material.

It is a further object of this invention to provide such a separation method and apparatus that functions effectively on "soft" as well as "hard" magnetic materials.

It is a further object of this invention to provide such a separation method and apparatus which is extremely effective for separating weakly magnetic grains of impurities from fibrous material in concentrated solutions.

It is a further object of this invention to provide such a separation method and apparatus using simultaneous application of a magnetic field and a mechanical force field.

It is a further object of this invention to provide such a separation method and apparatus which is extremely efficient for separating very dilute slurries even less than 1% solid.

It is a further object of this invention to provide such a separation method and apparatus which subjects a slurry to be separated to a first flow in which particles are removed by mechanical means and concentrated into a much smaller second flow which is subjected to a high gradient magnetic field.

The invention features a method of separating more magnetically susceptible particles from less magnetically susceptible particles carried in a fluid medium. It includes simultaneously subjecting the medium to a magnetic field and a mechanical force field for separating the medium into a first flow in which magnetically susceptible particles magnetically flocculate under the influence of the magnetic field to form larger particles and a second flow which is adjacent and in communication with the first flow and which moves locally, transversely to the first flow. These larger particles are urged from the first flow to the second flow by means of the magnetic field and the mechanical force field. Larger particles entering the second flow are entrapped by means of localized regions of high magnetic field gradient located along the path of the second flow. The force field may be a gravitational force field, a centrifugal force field or a combination of both. The magnetic field may be periodically reduced or may have its polarity alternately reversed as the device is being flushed to free the entrapped particles which have been collected. The second flow may also be subjected to an electrostatic field to further aid in the separation of particles on the basis of electric surface charge on the particles.

The invention also features a separator for separating more magnetically susceptible particles from less magnetically susceptible particles carried in a fluid medium using simultaneous application of a magnetic field and a preestablished mechanical force field. The preestablished mechanical force field may be a gravitational field which is existing in the environment of the separator or may be a centrifugal force field which is present because of the motion of the slurry through the separator or both such mechanical force fields may be present. There is a first magnetic member defining a first flow path in which magnetically susceptible particles magnetically flocculate under the influence of a magnetic field to form larger particles. A second magnetic member is spaced from the first magnetic member and defines a second flow path adjacent, in communication with and locally transverse to the first flow path. There are means associated with at least one of the members for providing a magnetic field between the members through the first and second flow path and transverse to the flow paths. The first flow path establishes a plurality of successive ridges transverse to the second flow path and having localized regions of high magnetic field gradient between them and the second member. The larger particles are urged from the first flow path to the second flow path by the magnetic field and the mechanical force field. The larger particles entering the second flow path are entrapped by the magnetic field at the ridges along the second flow path. Means may be provided for producing an electrostatic field between the members for aiding the separation of particles on the basis of electric surface charge.

In one embodiment the first member is generally cylindrical and the first flow path includes a helical channel bounded by a ridge disposed about that first member and the second member is generally cylindrical and holow and the second flow path is an annular, generally cylindrical duct between the channel and ridge and the second member. The helical flow path may be oriented with its longitudinal axis horizontal or vertical. In the latter the medium may be directed either upwardly or downwardly in the helical channel.

In another embodiment the first and second members are planar or curviplanar and the first flow path includes a plurality of long adjacent channels bounded by ridges disposed on the first member and the second flow path is a laminar duct between the channels and ridges on the first member and the second member. Flow is directed along the channels and if the channels are inclined may be directed either up or down the incline.

DISCLOSURE OF PREFERRED EMBODIMENT

Other objects, features and advantages will occur from the following description of a preferred embodiment and the accompanying drawings, in which.

Figure 1:
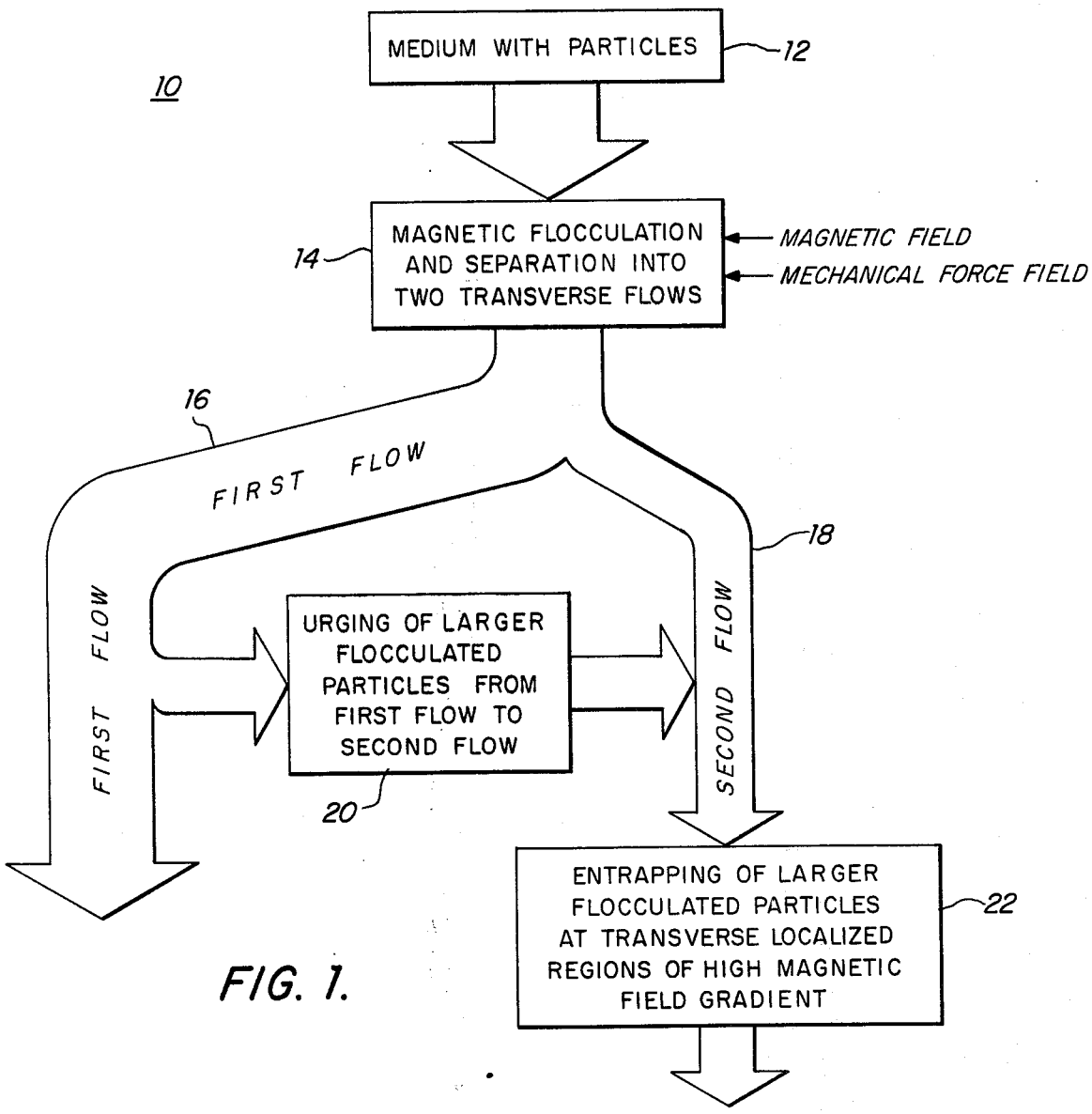
FIG. 1 is a block diagram illustrating the method of this invention.

The invention may be accomplished using a method of separating more magnetically susceptible particles from less magnetically susceptible particles carried in a fluid medium in which the medium is simultaneously subjected to a magnetic field and a mechanical force field for separating the medium into a first flow in which magnetically susceptible particles magnetically flocculate under the influence of the magnetic field to form larger particles and a second flow which is adjacent and in communication with the first flow and which moves locally, transversely of the first flow. Larger particles are urged from the first flow to the second flow by means of the magnetic field and the mechanical force field. Entrapping of the larger particles entering the second flow is accomplished by means of localized regions of high magnetic field gradient located along the path of the second flow. The second flow which passes through the regions of high gradient magnetic field is shielded from the higher velocities which occur in the main flow and therefore the particles are trapped in regions where viscous forces are substantially reduced so that the ratio of magnetic trapping force to hydrodynamic drag force is enhanced. The mechanical force field may be a gravitational force field which exists at the separation site or a centrifugal force field created by the motion of the medium in a curved path or it may include both a gravitational force field and a centrifugal force field. The second flow moves locally, transverse to the first flow but generally may move either transversely or in the same direction as the first flow. The centrifugal force field typically is much stronger than the gravitational force field. The gravitational force field only becomes significant in the separation process when the second flow path approaches a vertical orientation or when there is no centrifugal force field. Periodically the magnetic field is reduced and flushing is effective to free the entrapped larger particles.

As an alternative to simply reducing the magnetic field for the flushing operation the magnetic field may be alternately reversed in polarity such as by the application of an AC energization source, for the purpose of removing residual magnetization of particles as well as of the iron structure of the separator.

The invention may also be accomplished by using a separator for separating more magnetically susceptible particles from less magnetically susceptible particles carried in a fluid medium using simultaneous application of a magnetic field and a preestablished mechanical force field. There is a first magnetic member for defining the first flow path in which the magnetically susceptible particles magnetically flocculate under the influence of a magnetic field to form larger particles. A second magnetic member is spaced from the first magnetic member and defines a second flow path adjacent, in communication with, and locally transverse to the first flow path. There are means associated with at least one of the members for providing a magnetic field between the members through and transverse to the first and second flow paths. The first flow path establishes a plurality of successive ridges transverse to the second flow path and having localized regions of high magnetic field gradient between them and the second member. The larger particles are urged from the first flow path to the second flow path by the magnetic field and the mechanical force field. The larger particles entering the second flow path are entrapped by the magnetic field at the ridges along the second flow path.

In one construction the first member is generally cylindrical and the first flow path includes a helical channel bounded by a ridge disposed about the first member while the second member is generally cylindrical and hollow and the second flow path is an annular, generally cylindrical duct between the channel and ridge and the second member. When the members are positioned with their longitudinal axes generally horizontally oriented the centrifugal force field is the major effective force field. When the members are positioned with their longitudinal membersvertically oriented the gravitational force field also becomes significant in the separation; with the vertical orientation of the longitudinal axes the flow may be upwardly or downwardly in the helical path. The magnetic field is typically provided by an electro-magnetic coil mounted on the first member. The first member may include two or more successive segments with the helical channel reversing its pitch direction on alternate segments in order to induce mixing of the medium. The mixing takes place without great turbulence: after the initial turbulence induced by the changing direction at the beginning of a new segment the flow tends to become more laminar thereby facilitating the sedimentation of the larger flocculated particles. The second flow path or duct which in the helical embodiment is an annular cylindrical path has essentially laminar flow throughout its course, and usually a much smaller flow volume than the main, helical flow path.

In another construction the first and second members are planar or curviplanar and the first flow path includes a plurality of long adjacent channels bounded by ridges disposed on the first member and the second flow path is a laminar duct between the channels and ridges on the first member and the second member. The channels may be inclined and the movement of the medium may be either up or down the incline. Typically, in this construction the members are oriented generally vertically and the channels extend across the longitudinal dimension. With the members oriented vertically or slightly inclined to the vertical the mechanical force field is primarily a gravitational force field; if the members are curviplanar the force field may also include a centrifugal force field.

The tops of the ridges in both types of construction have sharp top edges facing toward the second member. It is at these sharp top edges that the localized regions of high magnetic field gradient occur between the ridges and the second member where the larger magnetically flocculated particles are entrapped. Alternatively, the ridges may be crowned with high gradient matrix material e.g. steel wool, expanded metal, interposed in the second flow path (if the medium is not fibrous). The removal by the mechanical force from the first flow of particles to produce a second, smaller, but more concentrated flow which is subjected to a high magnetic field gradient makes this separation method and apparatus particularly suitable for processing of very dilute slurries e.g. 1% or less solid which would otherwise have to be passed in their entirety through a high gradient magnetic separator at considerably higher cost.

There is shown in FIG. 1 a block diagram 10 illustrating a separation method according to this invention in which the medium with the particles 12 is introduced simultaneously to a magnetic field and a mechanical force field. Under the influence of these fields the particles magnetically flocculate and the medium spontaneously separates 14 into two transverse flows, a first flow 16 and a second flow 18. Still under the influence of the field there occurs an urging 20 of the larger flocculated particles from the first flow to the second flow. Entrapping 22 of the larger flocculated particles in the second flow occurs at transverse localized regions of high magnetic field gradient. Periodically the flow of the medium with the particles is stopped and the system flushed while the magnetic field is deenergized to recover the entrapped larger particles.

Figure 2:
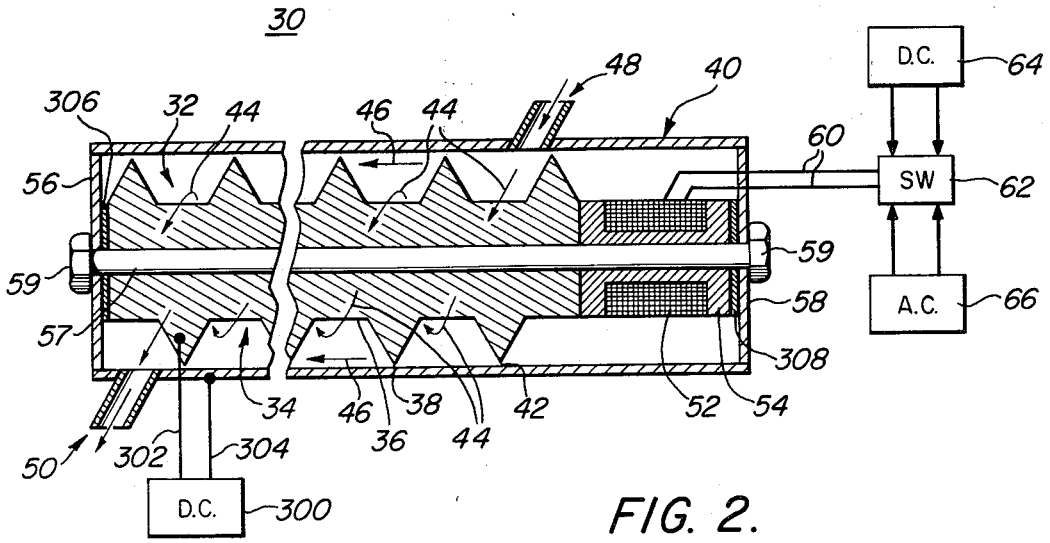
FIG. 2 is a simplified, schematic, sectional diagram of a separator with a helical flow path and associated control circuitry according to this invention.

A separator 30, FIG. 2, according to this invention includes a first, inner, cylindrical member 32 having a first, helical flow path 34 defined by helical channel 36 and helical ridge 38. A second, outer, hollow cylindrical member 40 surrounds member 32 and is spaced therefrom to provide a second annular cylindrical laminar duct 42 in the space between channel 36 and ridge 38 on first member 32 and the second member 40. The medium in the first flow path 34 follows the direction of arrow 44 while that in the second flow path 42 follows the direction of arrows 46. A single ridge 38 therefore defines a plurality of ridges which are transverse to the second flow path 42 to provide localized regions of high magnetic field gradient transverse to flow path 42. Inlet 48 and outlet 50 may be provided in member 40 and oriented to take advantage of the helical pitch for delivery and removal of the fluid. The entire assembly may be held together by means of shaft 57 secured by nuts 59. Coil 52 mounted on spool 54 generates a magnetic field which extends longitudinally through member 32, radially outwardly in magnetic end plate 56 and returns through magnetic member 40 and end plate 58 to spool 54. Coil 52 is energized through lines 60 and switch 62 by DC source 64. Coil 52 may be deenergized by disconnecting the coil from the DC source 64 or disconnecting it from source 64 and reconnecting it to alternating current source 66. Alternating current source 66 may be equipped with an attenuator to gradually diminish the strength of the AC field being used to demagnetize separator 30 during a flushing operation.

Figure 3:
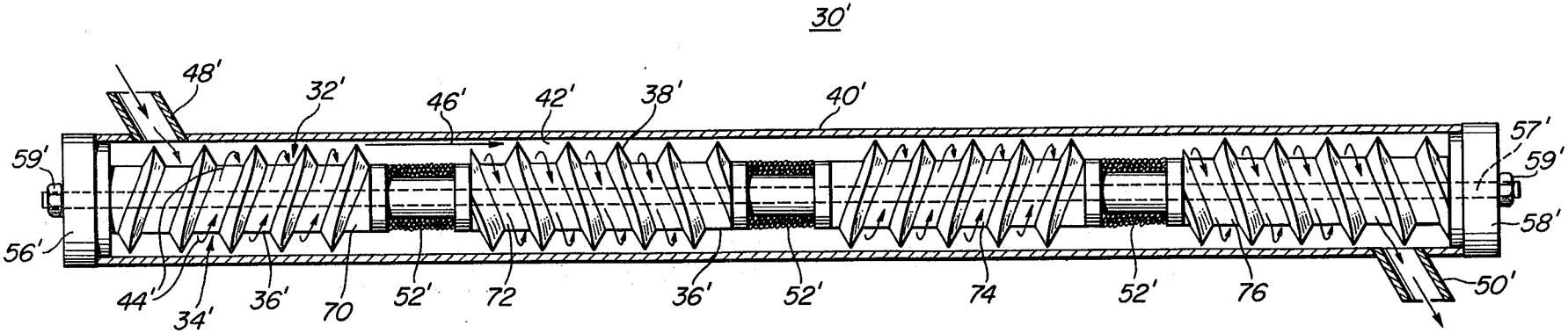
FIG. 3 is a simplified, schematic, sectional diagram of a plurality of members similar to those in FIG. 2 having helical flow paths and associated electromagnetic coils arranged in a stacked array with the pitch direction of the helical flow path reversed on alternate members in the stack according to this invention.

Alternatively, as shown in FIG. 3 where like parts have been given like numbers and similar parts like numbers primed, member 32' may include a plurality of segments 70, 72, 74 and 76 surrounded by member 40' and capped with end plates 56' and 58' secured by shaft 57' and nuts 59'. Three coils 52' are provided one between each pair of segments. The magnetic circuit and magnetic field distribution is similar to that shown in FIG. 2. Also as in FIG. 2 laminar, cylindrical, annular duct 42' with flow direction 46' is provided between ridge 38' and member 40'. Inlet 48' and outlet 50' are reversed with respect to their positions in FIG. 2. The pitch direction of channel 36' and ridge 38' is reversed in alternate ones of segments 70, 72, 74 and 76 to induce mixing of the medium as it moves in first flow path 34' in helical channel 36'. Thus arrows 44' indicate a right-hand or clockwise flow direction in channel 36' in segments 72 and 76 while arrows 44' indicate a left-hand or counterclockwise flow in channel 36' in segments 70 and 74. The pitch is again reversed in segment 74 so that it is identical to that in segment 70 and once again reversed in segment 76 so that it is similar to that in segment 72.

All of the coils 52' are wound and energized with direct current in the directions such that they cooperate in producing a unidirectional magnetic flux along the axis of member 32' and returning through the end plates 56', 58' and member 40'. Ridge 38' is triangular in cross-section; the base of the triangle is substantially shorter than the screw pitch of the helix so that the space between the threads is trapezoidal in cross section and forms a substantial flow duct of helical shape. The vertex of the ridge 38' is preferably sharp and smooth; the outer diameter of the ridge is somewhat smaller than the inside diameter of member 40' which results in formation of laminar, cylindrical, annular duct 42' which is substantially smaller in cross section than channel 36'.

In operation, a slurry of granular or fibrous particles suspended in the fluid i.e. either a liquid or gaseous medium, is introduced through inlet 48'. The predominant flow takes place through helical channel 36'. This flow path has a low back pressure and periodically reverses its direction of rotation to promote mixing of the fibrous pulp without the requirement for vanes, paddles or other mixing devices which are likely to clog.

Particles of higher density or higher magnetic susceptibility than the mixture in general are carried outward by the combined action of the centrifugal force field and the magnetic field. The particles are also exposed to the magnetic field throughout their passage through the device so that they tend to coagulate or flocculate magnetically into larger particles. Upon reaching duct 42' the particles are swept in an axial direction, arrow 46', in the secondary, lesser axial flow which surrounds the predominate helical flow. This carries the particles over the sharp vertices of the ridges 38' where they are trapped and retained with a high probability by the transverse localized regions of magnetic field gradient which exist in the vicinity of ridge 38'. Even if a trapped article be dislodged it is again subject to being entrapped when it encounters the next portion of ridge 38'.

A group of devices such as shown in FIGS. 2 and 3 may be mounted in close proximity, similar to the tubes of a boiler or heat exchanger and surrounded by a common jacket. This arrangement is particularly useful in cases where the medium must be kept at an accurately controlled temperature such as in purifying liquified pulp products of high viscosity, thermal plastic composites and similar products.

Although in FIG. 3 separator 30' is shown with its longitudinal axis oriented horizontally this is not a necessary limitation of the use of the device. For example, the device may be oriented with its longitudinal axis vertical so that in addition to the centrifugal force field the force of gravity provides a significant gravitational force field, useful in the separation process. This alternative is demonstrated simply by rotating the sheet of drawing 90° from its primary orientation. The functions of inlet 48' and outlet 50' may be interchanged i.e., outlet 50' may become the inlet and inlet 48' may become the outlet in either the vertical or horizontal orientation of system 30'.

Figure 4:
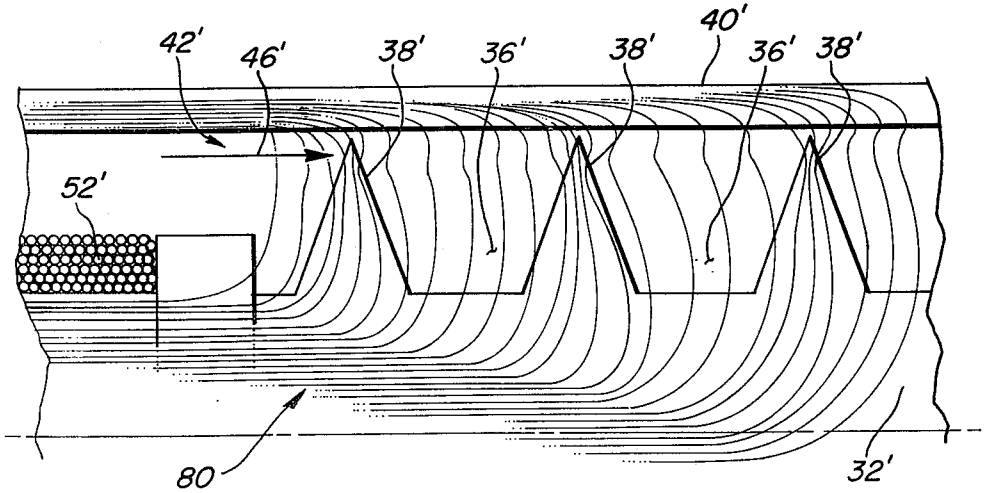
FIG. 4 is an enlarged view of a portion of FIG. 3 showing the magnetic flux path between the members.

A certain amount of magnetic flux 80, FIG. 4, extends in the radial direction from member 32' to member 40'. Some of the flux extends through channel 36'; higher density flux passes through ridge 38' where it creates localized regions of high gradient magnetic field between the ridge 38' and member 40' and transverse to the direction 46' of the flow in duct 42'.

Figure 5:
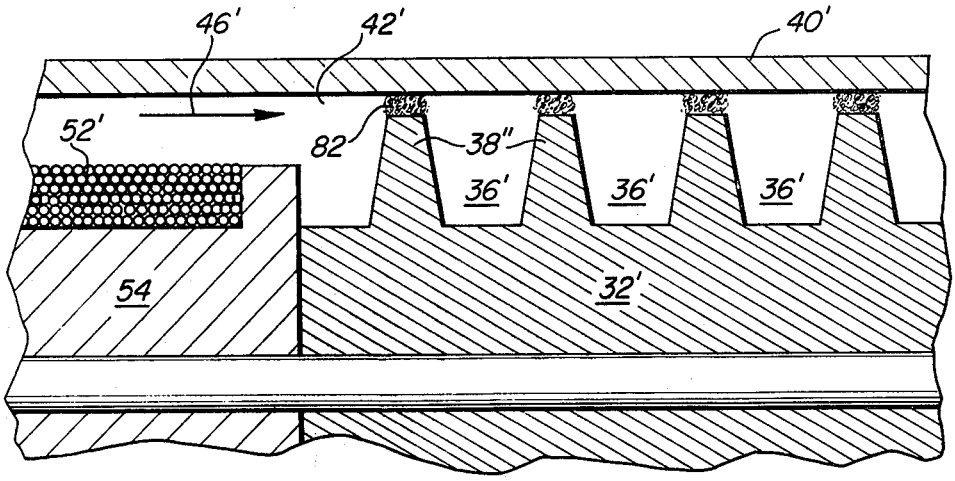
FIG. 5 is an enlarged view similar to FIG. 4 showing an alternate construction at the vertices of the ridges.

Alternatively, ridge 38'', FIG. 5, may be provided with a crown 82 of high gradient magnetic material such as steel wool to further enhance entrapment of the particles in duct 42'.

Figure 6:
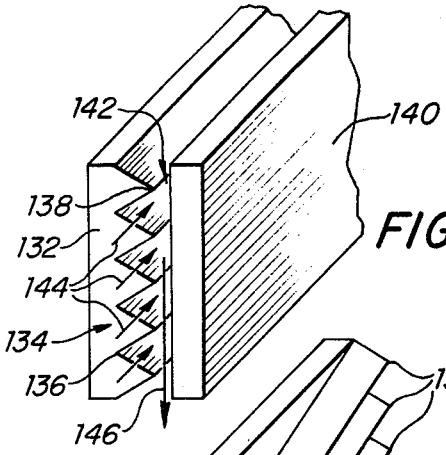
FIG. 6 is a simplified, schematic, sectional diagram of a portion of an alternate separator using planar members according to this invention.
Figure 7:
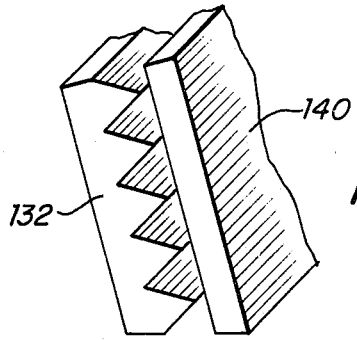
FIG. 7 is a schemtic sectional view showing the plates in FIG. 6 inclined to the vertical.
Figure 8:
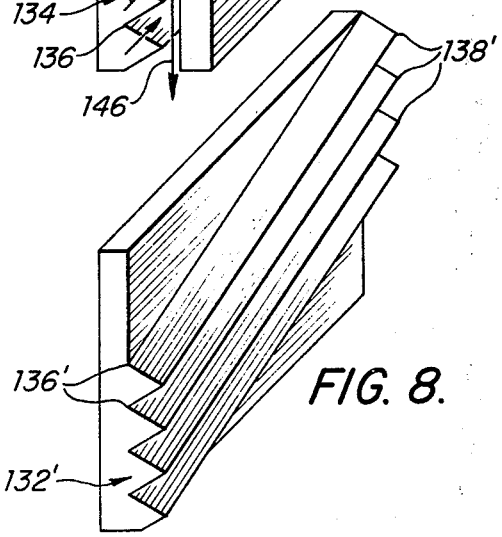
FIG. 8 is a diagrammatic illustration of an inclined channel variation which can be used in the separator of FIG. 6.
Figure 9:
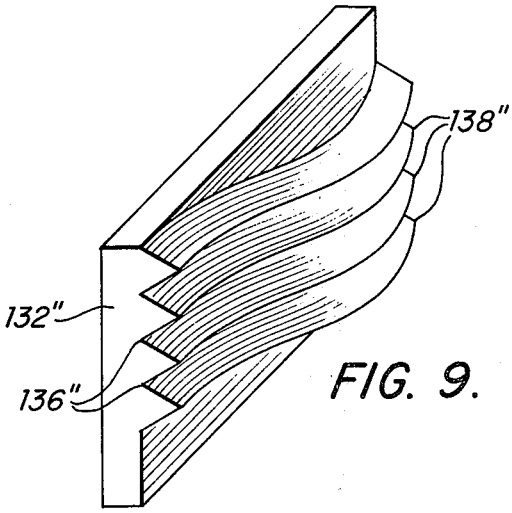
FIG. 9 is a diagrammatic illustration of a curved channel structure that can be used in the separator of FIG. 6.
Figure 10:
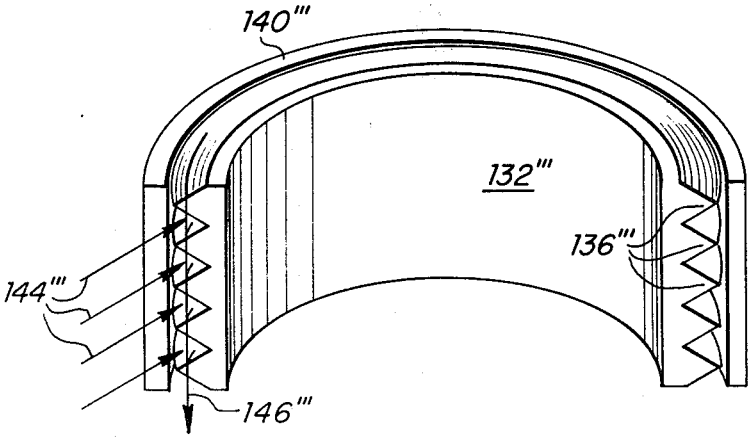
FIG. 10 is a schematic illustration of curviplanar plates which may be used in the separator of FIG. 6.

In an alternative construction, FIG. 6, the first and second members may be planar plates 132, 140, respectively. The first flow path 144 may include a plurality of adjacent channels 136. The second flow path 142 is defined by the space between plate 140 and ridges 138 and channels 136. In FIG. 6 the main flow path is indicated by arrows 144 and the second or sedimentary flow path is indicated by arrow 146. In the construction of FIG. 6 the gravitational force field is the primary, functional mechanical force field. Plates 132 and 140 may be oriented vertically with channels 136 extending across the longitudinal dimension of plate 132 or they may be inclined to the vertical as shown in FIG. 7 for varying the separation quality and speed. Although channels 136 are shown straight and generally horizontal in FIGS. 6 and 7, this is not a necessary requirement of the invention. For example, channels 136', FIG. 8, may be inclined and the medium may be fed from either end, either up or down the inclination. In addition channels 136'', FIG. 9, may be uniformly or randomly curved. Further, the plates may be curviplanar as shown in FIG. 10 where plate 132''' containing channels 136''' has a smaller radius of curvature and member 140''' has a larger radius of curvature. In this construction centrifugal force can be made significant.

The construction discussed with reference to FIGS. 6–10 may be used in a separator 150, FIG. 11, using plates 160, 162, 164 and 166, each of which constitutes both a first member and a second member in accordance with the explanations used previously in the specification. For example, plate 162 constitutes a first member in so far as it provides ridges 172 and channels 170 and constitutes a second member in so far as it provides surface 174 which cooperates with channels 170 and ridges 172 of plate 160. Side wall 176 of housing 152 functions as a second member with respect to plate 166. A coil having three parts 154, 156 and 158 is used to provide the necessary magnetic field. The first or main flow path is through channels 170 in the direction indicated by arrow 180. The second, sedimentation, flow path is indicated by arrows 182 in laminar duct 184.

Figure 12:
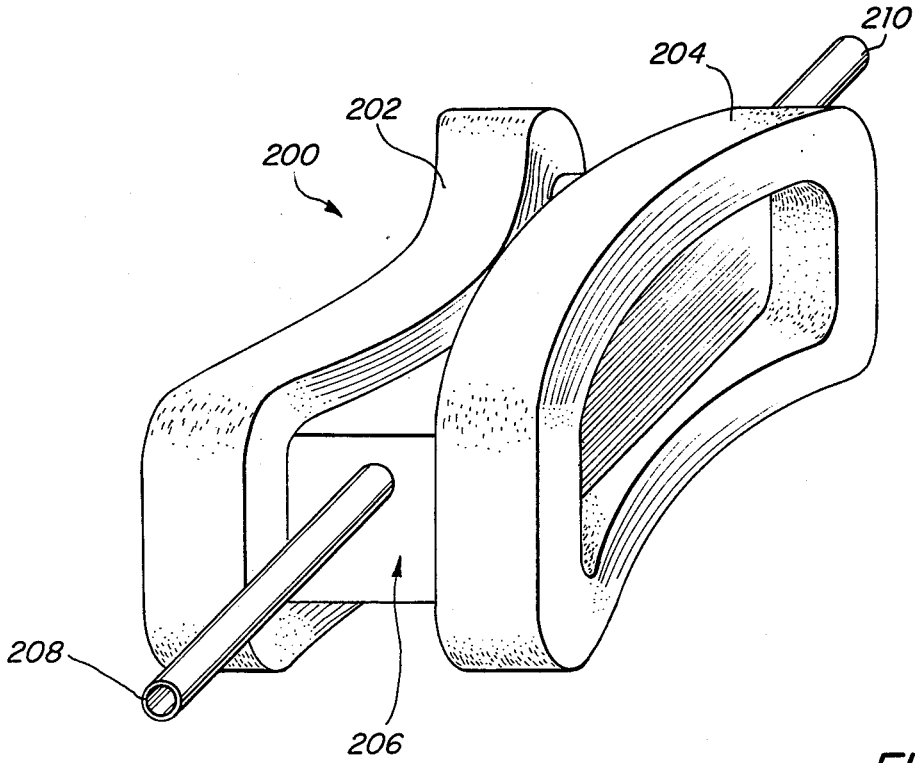
FIG. 12 is a more complete view of the enclosure of the separator in FIG. 11 showing alternate coil forms.

In an alternative construction, FIG. 12, coil 200 utilizes a split coil configuration having coil parts 202 and 204 which separate at the front of housing 206 to provide for inlet 208 and at the rear of housing 206 to provide for outlet 210.

An electrostatic field may be established between the members for further aid in separation of the particles on the basis of their surface charge. This can be accomplished with the device of FIG. 2 by adding a D.C. source 300 connected between members 32 and 40 through leads 302, 304 and electrically insulating those members from each other such as by discs or washers 306, 308. In the device of FIG. 11 the support structure (not shown) which holds plates 160, 162, 164, and 166 in spaced relation may be an electrical as well as magnetic insulator; plates 160, 162, 164 and 166 are connected to batteries 310, 312, and 314 by wires 316, 318, 320 and 322.

Figure 13:
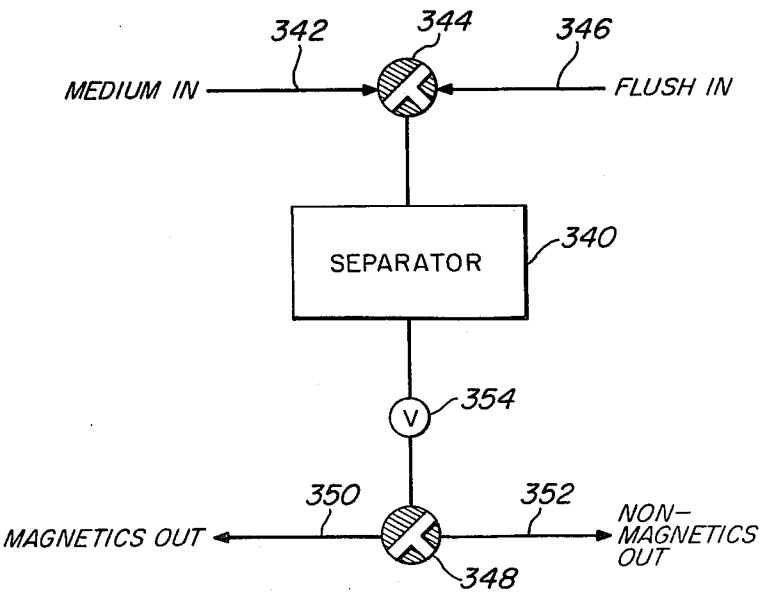
FIG. 13 is a schematic diagram of a hydraulic system usable with the separator of this invention.
Figure 11:
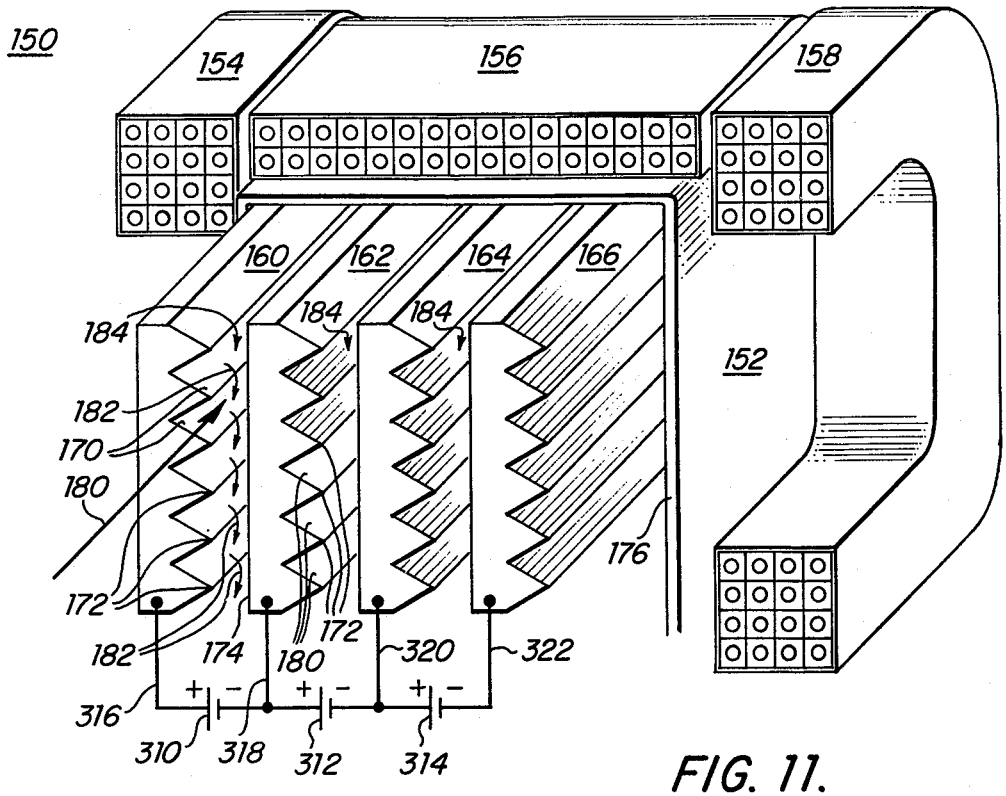
FIG. 11 is a partially broken away sectional view of an alternative separator construction similar to that in FIG. 6 according to this invention showing a preferred coil means for magnetizing the ridged plate structure.

Separator 30, FIG. 2, or separator 150, FIG. 11, may be connected in a hydraulic system such as illustrated in FIG. 13 where separator 340 may represent either separator 30 or 150. The medium to be separated is fed in through line 342 via three-way valve 344 which is periodically operated to substitute the flush fluid in line 346 for the medium to be separated in line 342. Three-way valve 348 selects magnetics out on line 350 during the flushing operation and non-magnetics out of line 352 during the separating operation. A flow control valve 354 adjusts the flow velocity of the fluids through separator 340 and insures that separator 340 is kept full with fluid to the desired level.

Other embodiments will occur to those skilled in the art and are within the following claims:

What is claimed is:

1. A method of separating more magnetically susceptible particles from less magnetically susceptible particles carried in a fluid medium comprising:

simultaneously subjecting said medium to a magnetic field and field gradient and a mechanical force field for separating said medium into a first flow in which magnetically susceptible particles magnetically flocculate under the influence of the magnetic field to form larger particles, and a second flow which is adjacent and in communication with said first flow and which moves locally transversely of said first flow, urging said larger particles from said first flow toward said second flow by means of said magnetic field gradient and said mechanical force field, and entrapping said larger particles entering said second flow by means of local regions of high magnetic field gradient located along the path of and transverse to said second flow.

2. The method of claim 1 in which said second flow generally moves in the same direction as said first flow.

3. The method of claim 1 in which said second flow generally moves transversely of said first flow.

4. The method of claim 1 in which said magnetic field and field gradient is transverse to said first and said second flows.

5. The method of claim 1 in which said mechanical force field is a gravitational force field.

6. The method of claim 1 in which said mechanical force field is a centrifugal force field.

7. The method of claim 1 in which said medium is also subjected to an electrostatic field for separating more magnetically susceptible particles from less magnetically susceptible particles on the basis of surface charge.

8. A separator for separating more magnetically susceptible particles from less magnetically susceptible particles carried in a fluid medium comprising:

a first magnetic member including a plurality of channels separated by ridges in which channels magnetically susceptible particles magnetically flocculate under the influence of a magnetic field to form larger particles;

a second magnetic member spaced from said first member and establishing a laminar duct between said channels and ridges and said second member, said duct being adjacent, in communication with the locally transverse to said channels; and means mounted about said members for producing a magnetic field between said members transversely to said channels and to said duct;

said ridges providing a succession of localized regions of high magnetic field gradient transverse to said duct, said larger particles being urged from said channels to said duct by said magnetic field, the said larger particles entering said duct being entrapped at said ridges by said magnetic field.

9. The separator of claim 8 in which said members are oriented generally vertically.

10. The separator of claim 8 in which said channels extend generally longitudinally across said first member.

11. The separator of claim 8 in which said members are inclined to the vertical.

12. The separator of claim 8 in which said channels are inclined to the horizontal.

13. The separator of claim 12 in which said medium flows up the incline.

14. The separator of claim 12 in which said members are planar.

15. The separator of claim 8 in which said members are planar.

16. The separator of claim 8 in which said members are curviplanar.

17. The separator of claim 8 in which said channels are curved.

18. The separator of claim 8 in which said ridges have sharp top edges facing said second member.

19. the separator of claim 8 in which said ridges are crowned with high gradient matrix material interposed in said duct.

20. The separator of claim 8 in which said channels are straight.

21. The separator of claim 8 in which said channels are curved.

22. The separator of claim 8 further including means for applying an electrostatic field between said members and means for electrically isolating said members from each other.

23. A separator for separating more magnetically susceptible particles from less magnetically susceptible particles carried in a fluid medium comprising:

a stack of magnetic plates spaced from each other, each said plate having on its first side a plurality of channels separated by ridges in which channels magnetically susceptible particles flocculate under the influence of a magnetic field and field gradient to form larger particles, a laminar duct established between said channels and ridges of one plate and the second side of an adjacent plate, said duct being adjacent, in communication with and locally transverse to said channels and ridges;

means mounted about said plates for producing a magnetic field between said plates transversely to said channels and duct;

said ridges providing a succession of localized regions of high magnetic field gradient transverse to said duct, said larger particles being urged from said channels to said duct by said magnetic field gradient, the said larger particles entering said duct being entrapped at said ridges by said magnetic field gradient.

24. A separator for separating more magnetically susceptible particles from less magnetically susceptible particles carried in a fluid medium comprising:

a first magnetic member defining a first flow path in which magnetically susceptible particles magnetically flocculate under the influence of a magnetic field to form larger particles;

a second magnetic member spaced from said first magnetic member defining a second flow path adjacent, in communication with, and locally transverse to said first flow path;

said first and second magnetic members being fixed against rotation relative to one another;

means associated with at least one of said members for providing a magnetic field and field gradient between said members through said first and second flow paths and transverse to said flow paths;

said first flow path including a plurality to successive ridges transverse to said second flow path and having localized regions of high magnetic field gradient between them and said second member, said larger particles being urged from said first flow path to said second flow path by said magnetic field and field gradient, the said larger particles entering said second flow path being entrapped by said magnetic field gradient at said ridges along said second flow path.

25. The separator of claim 24 in which said first member is generally cylindrical, said first flow path includes a helical channel bounded by a helical ridge disposed about said first member, said second member is generally cylindrical and hollow and said second flow path is an annular, generally cylindrical duct between said channel and ridge and said second member.

26. The separator of claim 25 in which said means for providing a magnetic field includes an electromagnetic coil mounted on said first member.

27. The separator of claim 25 in which said first member includes at least two successive segments and said helical channel reverses pitch direction on alternate said segments for inducing mixing of said medium.

28. The separator of claim 24 in which said first flow path includes a plurality of long, adjacent channels bounded by ridges disposed on said first member, and said second flow path is a laminar duct between said channels and ridges and said second member.

29. The separator of claim 28 in which said first and second members are planar.

30. The separator of claim 28 in which said first and second members are curviplanar.

31. The separator of claim 28 in which said channels are inclined and the movement of the medium is up the incline.

32. The separator of claim 28 in which said channels are inclined and the movement of the medium is down the incline.

33. The separator of claim 28 in which said members are oriented vertically and said channels extend across the longitudinal dimension of said first member.

34. The separator of claim 33 in which said members are inclined to the vertical.

35. The separator of claim 28 in which said channels are straight.

36. The separator of claim 28 in which said channels are curved.

37. The separator of claim 24 in which said ridges have sharp top edges facing said second member.

38. The separator of claim 24 in which said ridges are crowned with high gradient matrix material interposed in said second flow path.

39. the separator of claim 24 further including means for applying an electrostatic field between said members and means for electrically isolating said members from each other.

40. A separator for separating more magnetically susceptible particles from less magnetically susceptible particles carried in a fluid medium comprising:

a first generally cylindrical magnetic member including a helical channel bounded by a helical ridge in which magnetically susceptible particles magnetically flocculate under the influence of a magnetic field to form larger particles;

a second generally cylindrical, hollow magnetic member spaced from and surrounding said first member and defining an annular, cylindrical duct, between said helical channel and ridge and said second member, said duct being adjacent, in communication with and locally transverse to said helical channel;

said ridge providing a succession of localized regions of high magnetic field gradient transverse to said duct, said larger particles being urged from said helical channel to said duct by said magnetic field and gradient and said mechanical force field, the said larger particles entering said duct being entrapped at said localized regions of high magnetic field gradient.

41. The separator of claim 40 in which said first member includes at least two successive segments and said helical channel reverses pitch direction on alternate segments for inducing mixing of said medium.

42. The separator of claim 40 in which said ridge has a sharp top edge facing said second member.

43. The separator of claim 40 in which said ridge is crowned with high gradient matrix material interposed in said duct.

44. The separator of claim 40 further including means for applying an electrostatic field between said members and means for electrically isolating said members from each other.

* * * * *

UNITED STATES PATENT OFFICE

CERTIFICATE OF CORRECTION

Patent No. 4,144,163 Dated March 13, 1979

Inventor(s) Henry H. Kolm

It is certified that error appears in the above-identified patent and that said Letters Patent are hereby corrected as shown below:

Column 9, line 61, "the" should have been --- and ---; and

Column 11, line 9, "to" should have been --- of ---.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*